US011435133B1

(12) United States Patent
Barik et al.

(10) Patent No.: US 11,435,133 B1
(45) Date of Patent: Sep. 6, 2022

(54) REFRIGERATOR AND SHELVING SYSTEM FOR A REFRIGERATOR

(71) Applicant: WHIRLPOOL CORPORATION, Benton Harbor, MI (US)

(72) Inventors: Deeptiranjan Barik, Pune (IN); Anant Karanjikar, St. Joseph, MI (US); Vishal Marathe, Pune (IN); Kailash Shravan More, Pune (IN); Mahalingappa Mulimani, Pune (IN); Samadhan Tanaji Pandhare, Pune (IN); Kundan Shankarrao Rawate, Pune (IN); Abinash Sarma, Assam (IN)

(73) Assignee: WHIRLPOOL CORPORATION, Benton Harbor, MI (US)

( * ) Notice: Subject to any disclaimer, the term of this patent is extended or adjusted under 35 U.S.C. 154(b) by 0 days.

(21) Appl. No.: 17/240,426

(22) Filed: Apr. 26, 2021

(51) Int. Cl.
*F25D 25/02* (2006.01)
*A47B 96/02* (2006.01)

(52) U.S. Cl.
CPC ..... *F25D 25/024* (2013.01); *A47B 96/025* (2013.01); *F25D 2325/021* (2013.01); *F25D 2325/022* (2013.01)

(58) Field of Classification Search
CPC .. F25D 25/02; F25D 25/024; F25D 2325/021; F25D 2325/022; A47B 96/025
See application file for complete search history.

(56) References Cited

U.S. PATENT DOCUMENTS 1,247,367 A * 11/1917 Burchell ..... A47B 17/04 312/266
2,064,096 A * 12/1936 Whalen ..... F25D 25/02 312/300
2,855,262 A 10/1958 Sharpe
3,857,623 A * 12/1974 Schneller ..... A47B 46/005 312/266
4,528,825 A 7/1985 Khan
5,302,015 A * 4/1994 Du Vall ..... A47B 21/0314 312/282
5,577,823 A 11/1996 Maglinger
6,997,531 B2 * 2/2006 Kim ..... A47B 46/005 108/136

(Continued)

FOREIGN PATENT DOCUMENTS

CA 2071805 C 4/2002
CN 202254617 U 5/2012

(Continued)

*Primary Examiner* — Kimberley S Wright
(74) *Attorney, Agent, or Firm* — Brooks Kushman P.C.

(57) ABSTRACT

A shelving system includes a first shelf, rollers, hangers, and a second shelf. The first shelf has an upper surface and defines tracks below the upper surface. The rollers are disposed within the tracks. The hangers are rotatably secured to the rollers. The second shelf is rotatably secured to the hangers. The second shelf is configured to rotate about the rollers via the hangers upon engagement between the rollers and stops to transition from a lower position to an upper-forward position. The second shelf is configured to slide rearward from the upper-forward position to an upper-rearward position. The second shelf is configured to nest with the first shelf in the upper-rearward position.

19 Claims, 7 Drawing Sheets

(56) References Cited

U.S. PATENT DOCUMENTS

| | | | | |
|---|---|---|---|---|
| 7,270,384 | B2 * | 9/2007 | Koloff, Jr. | A47B 88/40 312/404 |
| 7,316,326 | B2 * | 1/2008 | Kim | A47B 46/005 211/150 |
| 7,618,103 | B2 * | 11/2009 | Kim | A47B 46/00 108/138 |
| 7,950,756 | B2 * | 5/2011 | Collins | F25D 25/02 312/408 |
| 8,100,488 | B2 * | 1/2012 | Eisele | F25D 23/067 312/408 |
| 8,226,184 | B2 | 7/2012 | Kang et al. | |
| 8,398,136 | B2 | 3/2013 | Miles | |
| 9,217,602 | B2 * | 12/2015 | Lee | F25D 25/02 |
| 9,222,723 | B2 * | 12/2015 | Seeley | F25D 25/02 |
| 9,243,839 | B2 | 1/2016 | Kim et al. | |
| 9,593,880 | B2 * | 3/2017 | Choo | F25D 25/024 |
| 9,638,458 | B2 | 5/2017 | Choo et al. | |
| 9,644,885 | B1 * | 5/2017 | Johnson | F25D 25/02 |
| 10,408,530 | B1 * | 9/2019 | Beck | A47B 96/024 |
| 10,408,531 | B1 * | 9/2019 | Beck | A47B 73/008 |
| 10,415,874 | B1 * | 9/2019 | Beck | A47B 96/062 |
| 10,823,491 | B2 * | 11/2020 | Beck | A47B 73/008 |
| 11,060,789 | B2 * | 7/2021 | Beck | A47B 43/003 |
| 2002/0109444 | A1 * | 8/2002 | Webb | A47B 23/02 312/313 |
| 2004/0207305 | A1 * | 10/2004 | Kim | F25D 25/027 312/408 |
| 2006/0097613 | A1 * | 5/2006 | Lee | F25D 25/02 312/408 |
| 2006/0125362 | A1 * | 6/2006 | Kim | F25D 25/024 312/408 |
| 2007/0176528 | A1 * | 8/2007 | Lee | F25D 25/02 312/408 |
| 2009/0058247 | A1 * | 3/2009 | Collins | F25D 25/02 62/440 |
| 2014/0252937 | A1 * | 9/2014 | Lee | F25D 25/02 312/404 |
| 2016/0146532 | A1 * | 5/2016 | Choo | F25D 25/024 312/408 |
| 2020/0088460 | A1 * | 3/2020 | Beck | F25D 25/024 |

FOREIGN PATENT DOCUMENTS

| | | | | |
|---|---|---|---|---|
| CN | 104976856 | A * | 10/2015 | |
| CN | 204787579 | U | 11/2015 | |
| CN | 106524660 | A * | 3/2017 | |
| JP | 4480666 | A | 6/2007 | |
| KR | 100650745 | B1 | 11/2006 | |
| WO | 1998005910 | A1 | 2/1998 | |
| WO | 2011076653 | A1 | 6/2011 | |
| WO | WO-2012022653 | A2 * | 2/2012 | F25D 25/021 |

* cited by examiner

REFRIGERATOR AND SHELVING SYSTEM FOR A REFRIGERATOR

TECHNICAL FIELD

The present disclosure relates to an appliance such as a refrigerator.

BACKGROUND

In order to keep food fresh, a low temperature must be maintained within a refrigerator to reduce the reproduction rate of harmful bacteria. Refrigerators circulate refrigerant and change the refrigerant from a liquid state to a gas state by an evaporation process in order cool the air within the refrigerator. During the evaporation process, heat is transferred to the refrigerant. After evaporating, a compressor increases the pressure, and in turn, the temperature of the refrigerant. The gas refrigerant is then condensed into a liquid and the excess heat is rejected to the ambient surroundings. The process then repeats.

SUMMARY

A refrigerator shelving system includes a first shelf, at least one roller, at least one hanger, and a second shelf. The first shelf has an upper surface, defines at least one track below the upper surface, and has at least one inwardly protruding tab disposed below the upper surface. The at least one roller is disposed within the at least one track. The at least one hanger is rotatably secured the at least one roller. The second shelf is rotatably secured to the at least one hanger and has at least one outwardly protruding tab. The second shelf is configured to rotate upward and forward about the rollers upon engagement between the at least one roller and the at least one stop to transition from a first position to a second position. The second shelf is configured to slide rearward from the second position to a third position such that the at least one outwardly protruding tab engages the at least one inwardly protruding tab to nest the second shelf to the first shelf.

A shelving system includes a first shelf, rollers, hangers, and a second shelf. The first shelf has an upper surface and defines tracks below the upper surface. The rollers are disposed within the tracks. The hangers are rotatably secured to the rollers. The second shelf is rotatably secured to the hangers. The second shelf is configured to rotate about the rollers via the hangers upon engagement between the rollers and stops to transition from a lower position to an upper-forward position. The second shelf is configured to slide rearward from the upper-forward position to an upper-rearward position. The second shelf is configured to nest with the first shelf in the upper-rearward position.

A refrigerator appliance includes a housing and a shelving system. The housing defines an internal chamber. The shelving system is disposed within the internal chamber. The shelving system includes an upper shelf, first and second opposing roller guide tracks, internal tabs, a plurality of rollers, stops, a plurality of hangers, a lower shelf, and external tabs. The upper shelf is anchored to an internal surface that partially defines the internal chamber. The first and second opposing roller guide tracks are disposed along a bottom surface of the upper shelf. The internal tabs protrude inward from the first and second roller guide tracks. A first portion of the plurality of rollers is disposed within the first roller guide track and a second portion of the plurality of rollers is disposed within the second roller guide track. The stops are disposed within the first and second roller guide tracks. The stops are configured to limit linear movement of the plurality of rollers within the first and second roller guides tracks. The plurality of hangers are each rotatably secured to one of the plurality of rollers. The lower shelf is disposed below the upper shelf and is rotatably secured to each of the plurality of hangers. The external tabs protrude outward from the lower shelf. The lower shelf is configured to pivot upward and forward about the plurality of rollers and via the hangers from a lower level to an upper level upon engagement between the plurality of rollers and the stops. The lower shelf is configured to slide rearward at the upper level from an advanced position to a retracted position that is below the upper shelf such that the external tabs engage upper surfaces of the internal tabs to retain the lower shelf in the retracted position at the upper level.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
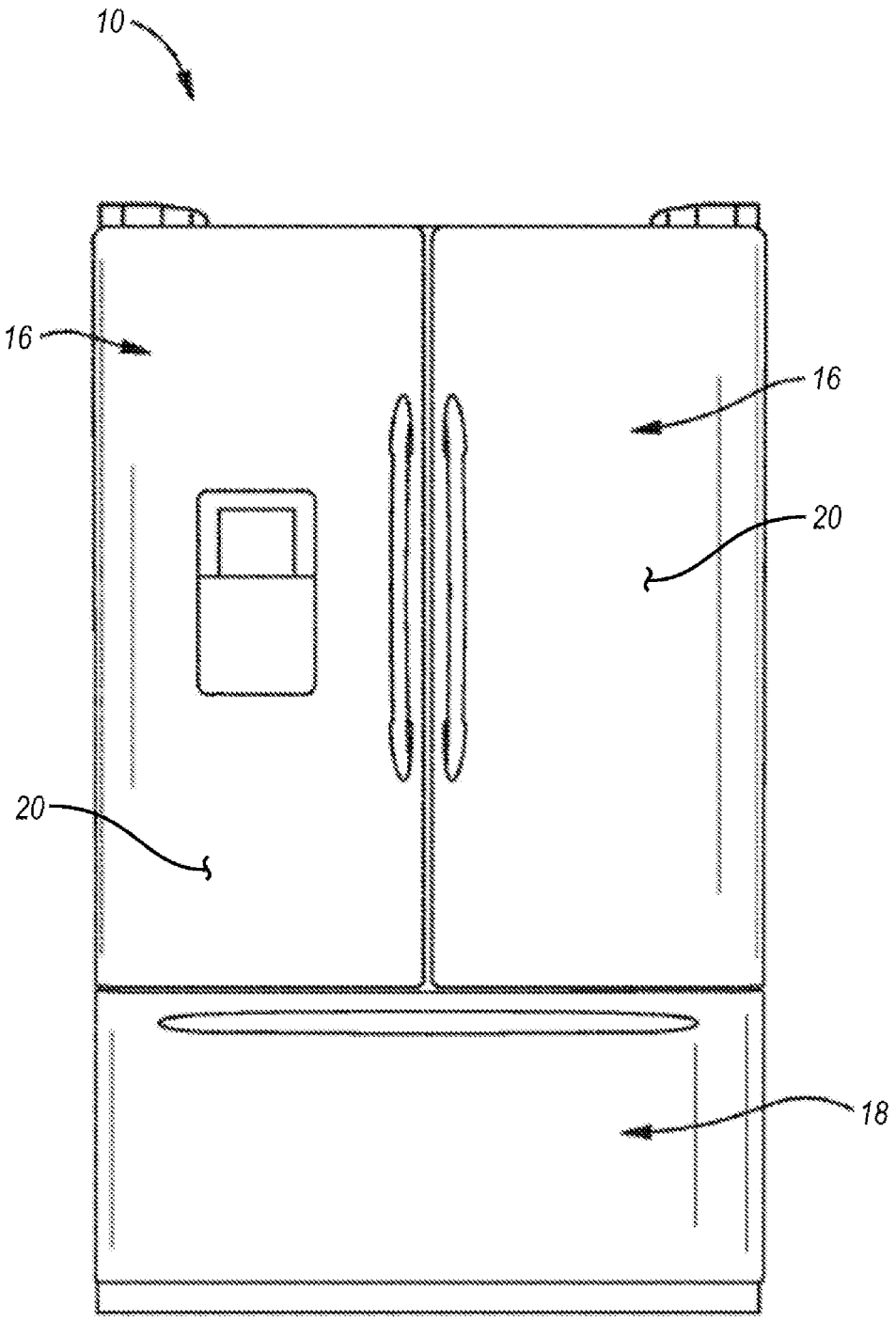
FIG. 1 is an elevated front view of a French-Door Bottom Mount type refrigerator appliance.
Figure 2:
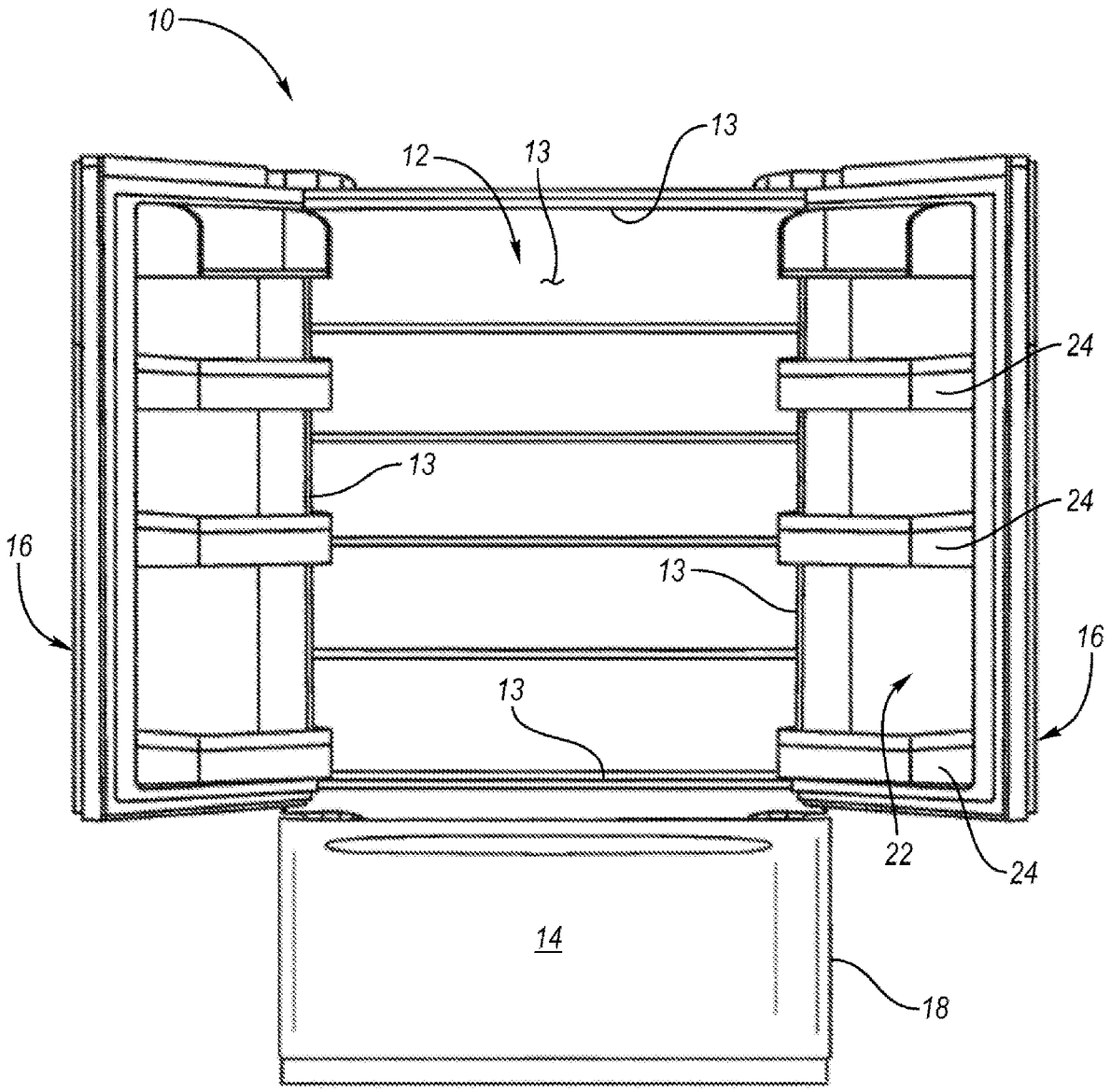
FIG. 2 is an elevated front view of a French-Door Bottom Mount type refrigerator with the refrigerator compartment doors open.
Figure 3:
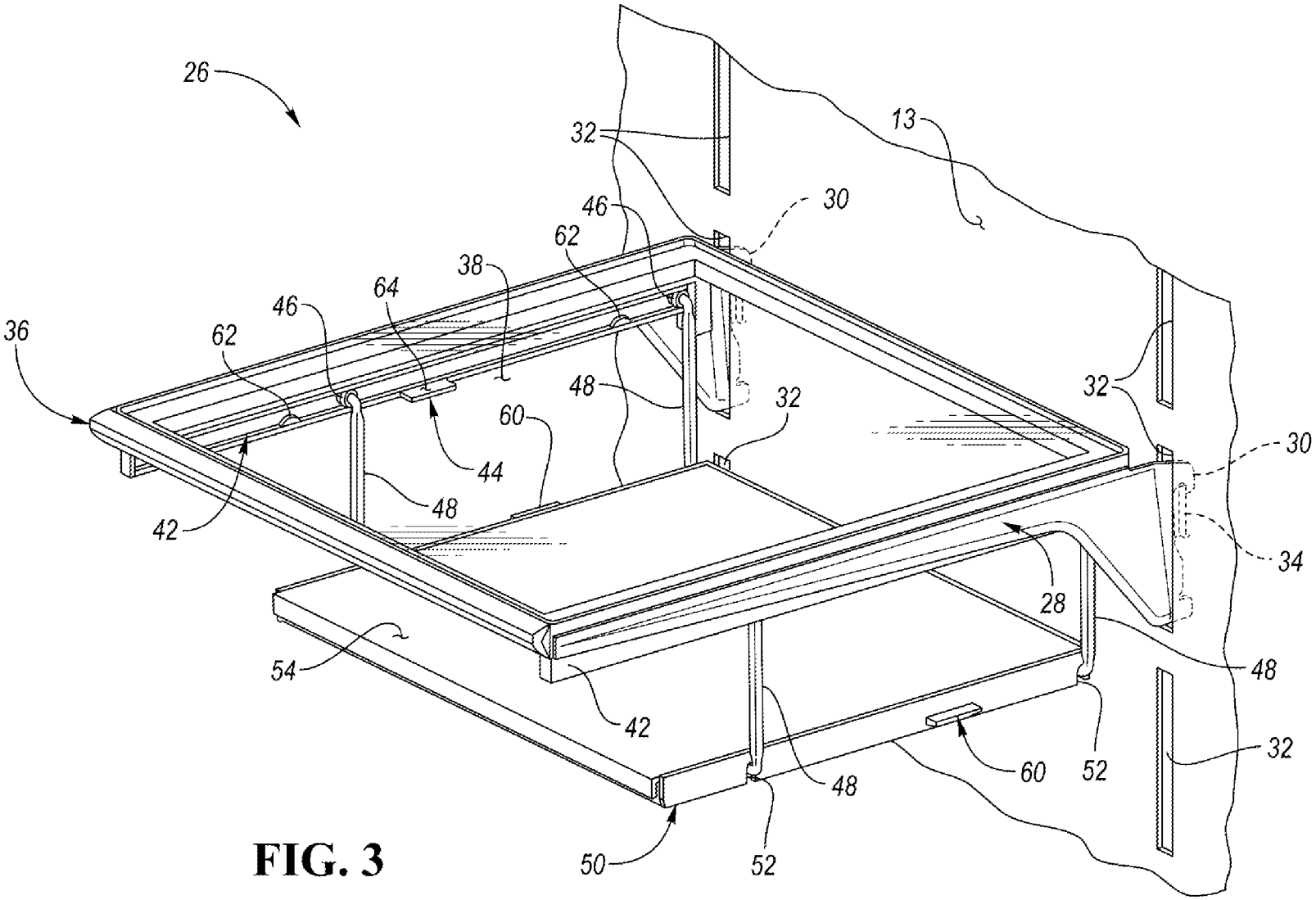
FIG. 3 is a top isometric view of a shelving system for the refrigerator that includes first and second shelves.
Figure 4:
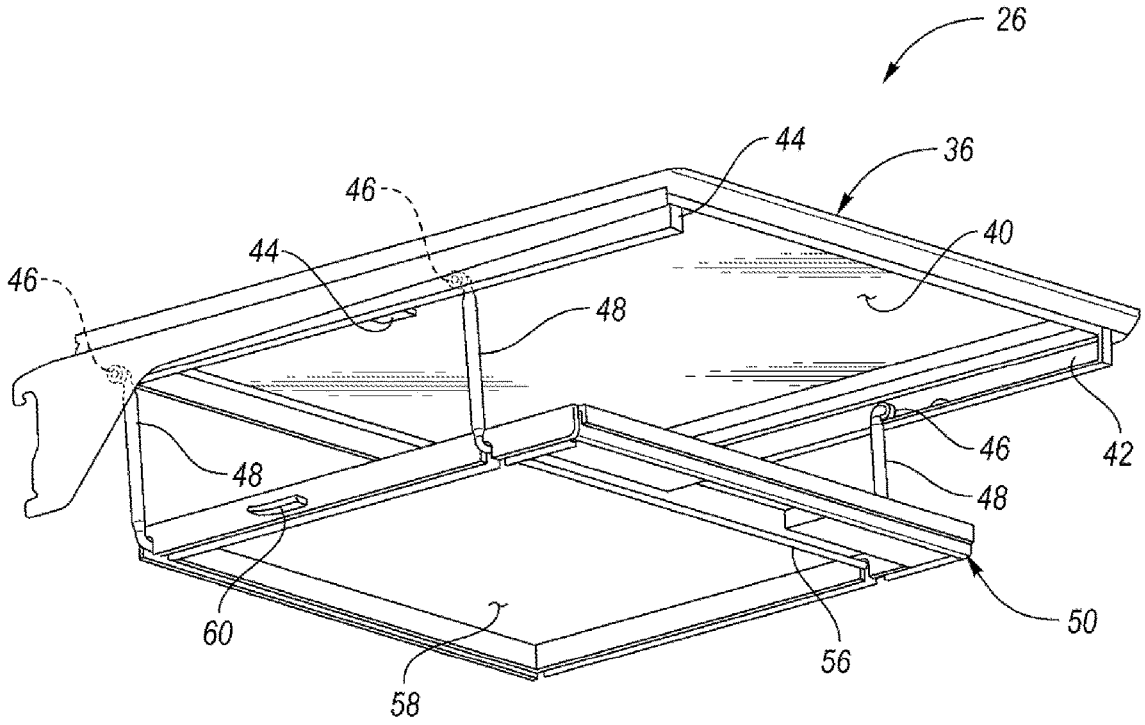
FIGS. 4-7 are isometric bottom views of the shelving system illustrating various positions of the second shelf relative to the first shelf.

Referring to FIGS. 1 and 2, generally a refrigerator 10 of the French-Door Bottom Mount type is illustrated. However, it should be understood that this disclosure could apply to any type of refrigerator, such as a side-by-side, two-door bottom mount, or a top-mount type. As shown in FIGS. 1 and 2, the refrigerator 10 may have a first internal storage chamber or fresh food compartment 12 configured to refrigerate and not freeze consumables within the fresh food compartment 12, and a second internal storage chamber or a freezer compartment 14 configured to freeze consumables within the freezer compartment 14 during normal use. The refrigerator 10 includes panels or walls 13 that form a housing and define the fresh food compartment 12 and the freezer compartment 14. The walls 13 may more specifically form an internal liner of the refrigerator 10. The walls 13 may include a rear or back wall, a top wall, a bottom wall, and two side walls. One or more shelves may be secured to the walls 13 within the food compartment 12. The refrigerator 10 may have one or more doors 16, 18 that provide selective access to the interior volume of the refrigerator 10 where consumables may be stored. As shown, the fresh food compartment doors are designated 16, and the freezer door is designated 18. It may also be shown that the fresh food compartment 12 may only have one door 16. The doors 16 may be rotatably secured to the walls 13 by one or more hinges.

It is generally known that the freezer compartment 14 is typically kept at a temperature below the freezing point of water, and the fresh food compartment 12 is typically kept at a temperature above the freezing point of water and generally below a temperature of from about 35° F. to about 50° F., more typically below about 38° F.

The doors 16 may each include an exterior panel 20 and an interior panel 22 that is disposed on an internal side of the respective exterior panel 20 of each door 16. The interior panels 22 may be configured to face the fresh food 12 compartment when the doors 16 are in closed positions (See FIG. 1). The interior panel 22 may more specifically be a door liner. An insulating material, such as an insulating foam, may be disposed between the exterior panel 20 and interior panel 22 of each door 16 in order reduce the heat transfer from the ambient surroundings and increase the efficiency of the refrigerator.

The refrigerator 10 may also have a water inlet that is fastened to and in fluid communication with a household water supply of potable water. Typically, the household water supply connects to a municipal water source or a well. The water inlet may be fluidly engaged with one or more of a water filter, a water reservoir, and a refrigerator water supply line. The refrigerator water supply line may include one or more nozzles and one or more valves. The refrigerator water supply line may supply water to one or more water outlets; typically one outlet for water is in the dispensing area and another to an ice tray. The refrigerator 10 may also have a control board or controller that sends electrical signals to the one or more valves when prompted by a user that water is desired or if an ice making cycle is required.

Such a controller may be part of a larger control system and may be controlled by various other controllers throughout the refrigerator 10, and one or more other controllers can collectively be referred to as a "controller" that controls various functions of the refrigerator 10 in response to inputs or signals to control functions of the refrigerator 10. The controller may include a microprocessor or central processing unit (CPU) in communication with various types of computer readable storage devices or media. Computer readable storage devices or media may include volatile and nonvolatile storage in read-only memory (ROM), random-access memory (RAM), and keep- alive memory (KAM), for example. KAM is a persistent or non-volatile memory that may be used to store various operating variables while the CPU is powered down. Computer-readable storage devices or media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by the controller in controlling the refrigerator 10.

The doors 16 may also include storage bins 24 that are able to hold food items or containers. The storage bins 24 may be secured to the interior panels 22 of each door 16. Alternatively, the storage bins 24 may integrally formed within or defined by the interior panels 22 of each door 16. In yet another alternative, a portion of the storage bins 24 may be secured to the interior panels 22 of each door 16, while another portion of the storage bins 24 may be integrally formed within or defined by the interior panels 22 of each door 16. The storage bins 24 may include shelves (e.g., a lower surface upon, which a food item or container may rest upon) that extend from back and/or side surfaces of the interior panels 22 of each door 16.

Referring to FIGS. 3-7, a shelving system 26 for the refrigerator 10 is illustrated. The shelving system 26 may be disposed within the internal chamber (i.e., the fresh food compartment 12) of the refrigerator 10. A single shelving system 26 or multiple shelving systems that are identical to shelving system 26 may be disposed within the internal chamber of the refrigerator. It should be noted that any shelves illustrated in FIG. 2 may be removed or rearranged to create space for one or more of the shelving systems 26. The shelving system 26 may include support arms 28 that engage one of the walls 13 that define the internal chamber 12 in order to secure the position of the shelving system 26 within the internal chamber 12. More specifically, hooks 30 defined along the end of the support arms 28 may extend into notches 32 defined by the wall 13 and may engage upwardly extending protrusions 34, bumps, walls, etc. within the notches 32 to secure the position of the shelving system 26 within the internal chamber 12. The wall 13 may define a plurality of vertically aligned notches 32 having protrusions 34 disposed therein so that the shelving system 26 can be adjusted upward or downward between notches 32 in order to adjust a height of the shelving system 26 within the internal chamber 12.

The shelving system 26 includes an upper or first shelf 36 that is secured to or is integral to the support arms 28. The first shelf 36 is secured to the wall 13 via the support arms 28. The first shelf 36 has a top or upper surface 38 and a lower or bottom surface 40 that each extend between the support arms 28. Food or other items may be stored on the top surface 38. The top surface 38 may be leveled to in order prevent items that are stored on the top surface 38 from rolling or falling off the top surface 38. It is noted that a panel that defines the upper surface 38 and bottom surface 40 is illustrated as being made from a transparent material, such as glass, in FIG. 3 for illustrative purposes. It should also be noted that although the panel could be made from such a transparent material, this disclosure should not be construed as limited to such a configuration.

One or more roller guide tracks 42 may be disposed along the bottom surface 40. More specifically, the roller guide tracks 42 may comprise first and second opposing roller guide tracks. The roller guide tracks 42 may be secured to the first shelf 36 and/or the support arms 28 along or adjacent to the bottom surface 40. Alternatively, the roller guide tracks 42 may be integral to and defined by the first shelf 36. The roller guide tracks 42 may be substantially parallel relative to each other and substantially parallel to the support arms 28. Substantially parallel may refer to any value that ranges between exactly parallel and 15° from exactly parallel.

One or more internal or inwardly protruding tabs 44 extend inward from the first shelf 36 at a position that is below the upper surface 38 and bottom surface 40. More specifically, the inwardly protruding tabs 44 may extend inward and toward each other from the roller guide tracks 42 at a position that is below the upper surface 38 and bottom surface 40. Each inwardly protruding tab 44 may be substantially parallel to the other inwardly protruding tabs 44. Substantially parallel may refer to any value that ranges between exactly parallel and 15° from exactly parallel. The inwardly protruding tabs 44 may be substantially perpendicular to the roller guide tracks 42 and to the support arms 28. Substantially perpendicular may refer to any value that ranges between exactly perpendicular and 15° from exactly perpendicular.

The shelving system 26 also includes one or more (or a plurality of) followers or rollers 46 and one or more (or a plurality of) hangers 48. At least one of the rollers 46 is disposed within each roller guide track 42. Stated in other terms, a first portion of the rollers 46 may be disposed within a first of the roller guide tracks 42 and a second portion of the rollers 46 may be disposed within a second of the roller guide tracks 42. Each hanger 48 is rotatably secured to one of the rollers 46 at a first end and is rotatably secured to a lower or second shelf 50 at a second end. The second shelf 50 is disposed below the first shelf 36. The rollers 46 may define central orifices and the hangers 48 may have upper horizontal portions that are each disposed within the central orifice of one roller 46 such that each roller 46 may rotate freely about the upper horizontal portion of an associated hanger 48.

The second shelf 50 may define notches 52 and lower horizontal portions of each hanger 48 may be disposed in and may rotate freely within one of the notches 52. The hangers 48 include vertical portions that extend between the upper and lower horizontal portions. The upper horizontal portions and lower horizontal portions of each hanger 48 may be substantially parallel to each other. Substantially parallel may refer to any value that ranges between exactly parallel and 15° from exactly parallel. The vertical portions of each hanger 48 may be substantially perpendicular to the respective upper horizontal portion and lower horizontal portion of each hanger 48. The notches 52 and lower horizontal portions of each hanger 48 may be disposed along edges and at or proximate to each corner of the second shelf 50 to provide balance and stability to the second shelf 50 so that food or other items may be stored on a top surface 54 of the second shelf 50. The vertical portions of each hanger 48 may be sized so that the four corners of the second shelf 50 are approximately located at the same vertical level in order prevent items that are stored on the top surface 54 from rolling or falling off of the top surface 54. Crossbars 56 may extend along a bottom surface 58 of the second shelf 50 and may connect the lower horizontal portions of a pair of hangers 48 to each other in order to provide further stability to the lower shelf 50.

One or more external or outwardly protruding tabs 60 extend outward from the second shelf 50. More specifically, the outwardly protruding tabs 60 may extend outward from opposing sides or side surfaces of the second shelf 50 and away from each other at positions that are below the upper surface 54. Each outwardly protruding tab 60 may be substantially parallel to the other outwardly protruding tabs 60 and may be substantially parallel to the inwardly protruding tabs 44. Substantially parallel may refer to any value that ranges between exactly parallel and 15° from exactly parallel.

One more stops 62 are disposed within each of the roller guide tracks 42 The stops 62 are configured to limit linear movement of the rollers 46 within the roller guide tracks 42. The second shelf 50, hangers 48, and rollers 46 are configured to slide forward from a lower-rearward position of the second shelf 50 (i.e., the position in FIG. 4) via the rollers 46 until the rollers engage the stops 62 at a lower-forward position.

Figure 5:
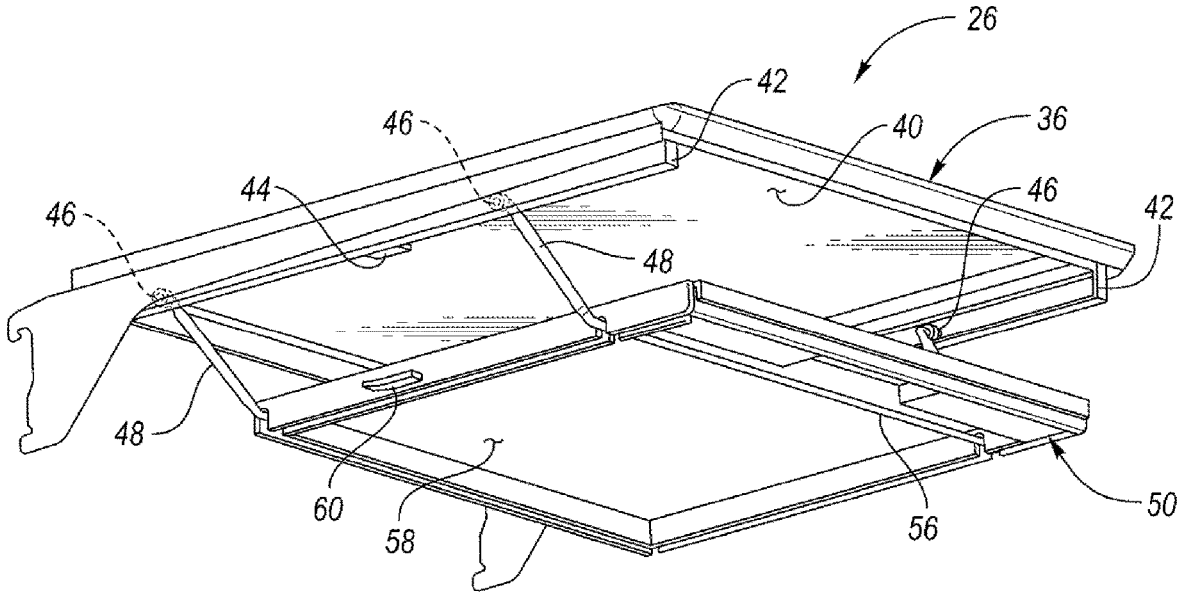
Figure 6:
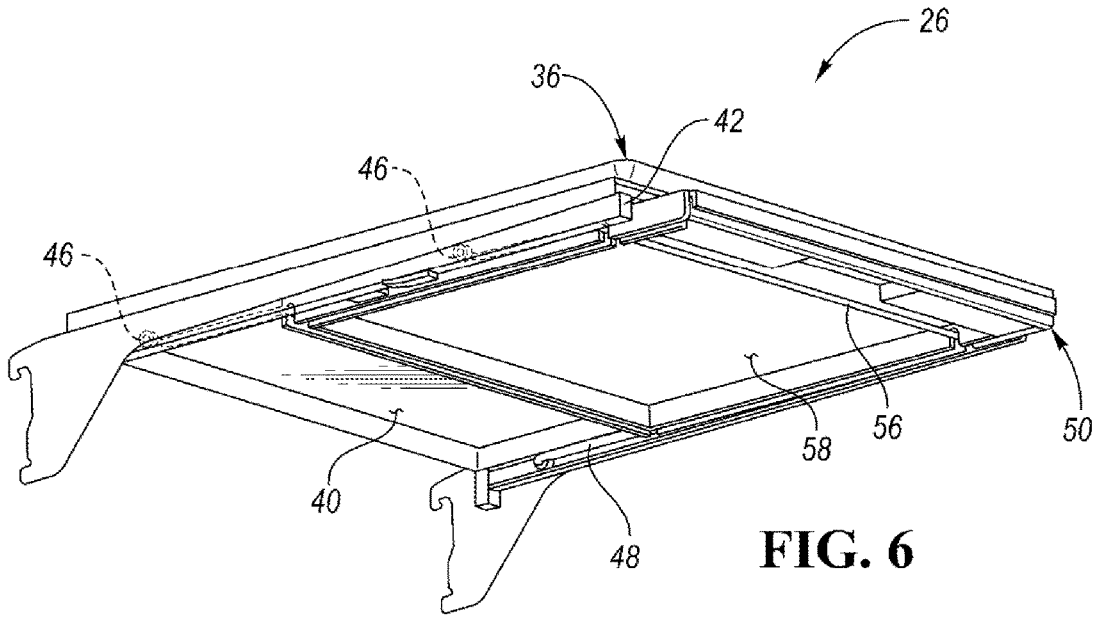

The second shelf 50 is then configured to rotate or pivot upward and forward about the rollers 46 and via the hangers 48 from a lower or first position at a lower level (see FIG. 4) to a an upper-forward or second position at a upper level (see FIG. 6) upon engagement between the rollers 46 and the stops 62. The first position may refer to any position at the lower lever or may more specifically refer to a position where the rollers 46 first engage the stops 62 but rotation of the shelf 50 has yet to occur such the second shelf 50 is still at the lower level (i.e., the lower-forward position). The second shelf 50 is suspended below the first shelf 36 via the hangers 48 while the second shelf 50 is at any position at the lower level. The second shelf 50 is disposed at least partially forward of the first shelf 36 at the upper level when the second shelf 50 is in the upper-forward or second position (see FIG. 6). FIG. 5 illustrates an intermediate position (i.e., a position of the second shelf 50 that is above the level lower and below the upper level) where the second shelf 50 is being rotated upward and forward about the rollers 46 and via the hangers 48.

Figure 7:
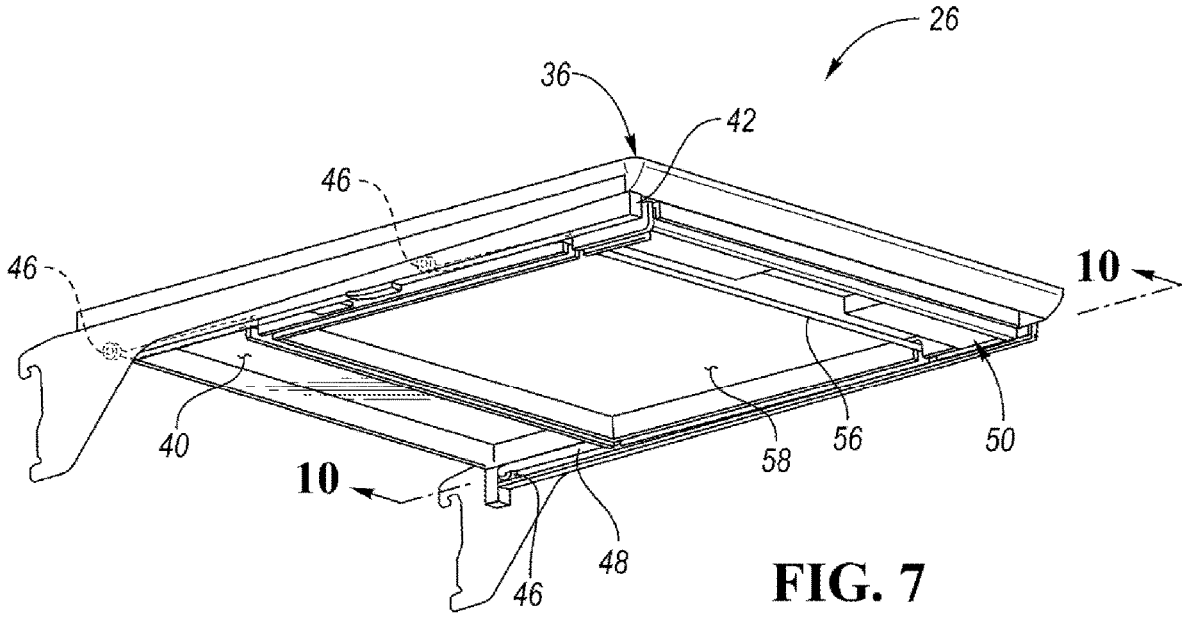

The second shelf 50 is then configured to slide rearward at the upper level from the upper-forward or second position to an upper-rearward or third position where the second shelf 50 is completely below and nested within the first shelf 36 between the roller guide tracks 42 (see FIG. 7). The upper-forward or second position may also be referred to as an advanced position while the upper-rearward or third position may also be referred to as a nested or retracted position. The second shelf 50 is configured to nest with the first shelf 36 and between the roller guide tracks 42 when in the upper-rearward or third position. More specifically, the outwardly protruding tabs 60 are configured to engage with inwardly protruding tabs 44 to nest the second shelf 50 to the first shelf 36 when the second shelf 50 is in the upper-rearward or third position. Even more specifically, the outwardly protruding tabs 60 engage upper surfaces 64 of the inwardly protruding tabs 44 to retain the lower shelf 50 in the upper-rearward or third position at the upper level. Nesting or nested objects (e.g., the second shelf 50 and the first shelf 36 as illustrated in FIG. 7) may refer to when similar objects of graduated sizes are placed or stored one inside the other.

Figure 8:
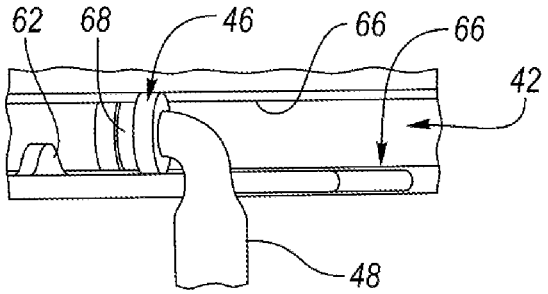
FIG. 8 is a first partial isometric view of a roller and a track that are each subcomponents of the shelving system.
Figure 9:
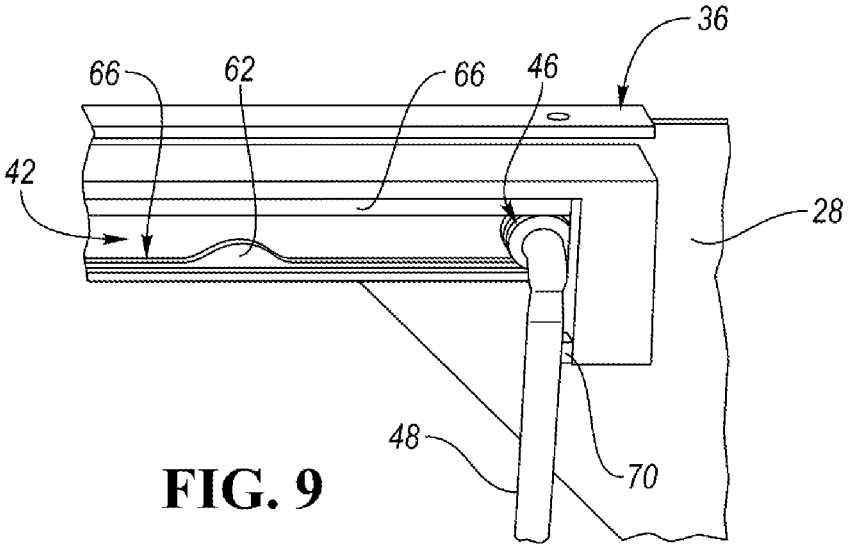
FIG. 9 is a second partial isometric view of the roller and the track.

Referring to FIGS. 8 and 9, the rollers 46 and portions of the roller guide tracks 42 are further illustrated. Although only one roller 46 and one roller guide track 42 are illustrated in FIGS. 8 and 9, it should be understood that the roller 46 and roller guide track 42 may be representative of all of the roller 46 and roller guide tracks 42 described herein. Furthermore, it should be understood that the roller and roller guide track configuration may include two roller guide tracks 42 with rollers 46 disposed therein that are mirror images to each other (see FIGS. 3-7).

One or more rails 66 may be disposed within the roller guide tracks 42. The rollers 46 may define grooves 68. The rails 66 may be disposed within the grooves 68 to guide the rollers 46 linearly within the roller guide tracks 42 and to prevent the rollers 46 from falling out of the roller guide tracks 42. The rails 66 may include an upper rail and a lower rail that are each disposed within the grooves 68 of the rollers 46. The stops 62 may be comprised of protrusions or bumps along the rails 66 that limit or restrict the linear movement of the rollers 46 along the roller guide tracks 42. For example, once the rollers 46 come into contact with the stops 62. the rollers 46 are restricted from further movement within the roller guide tracks 42 and the second shelf 50 then begins to rotate about the rollers 46 via the hangers 48. The first shelf 36 includes one or more backstops 70 that are configured to limit rearward movement of the hangers 48 and the second shelf 50 when the second shelf 50 is at the lower level and is suspended below the first shelf 36. The backstops 70 may be secured to or formed integrally with the roller guide tracks 42.

Figure 10:
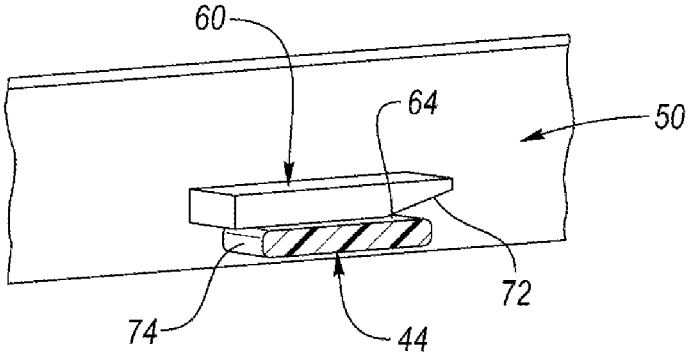
FIG. 10 is a cross-sectional view taken along line 10-10 in FIG. 7 illustrating an engagement between tab components of first and second shelves.

Referring to FIG. 10, the engagement between the outwardly protruding tabs 60 and the inwardly protruding tabs 44 to nest the second shelf 50 to the first shelf 36 when the second shelf 50 is in the upper-rearward or third position (see FIG. 7) is further illustrated. The lower surfaces 72 of the outwardly protruding tabs 60 may be ramped to facilitate engagement between the outwardly protruding tabs 60 and the inwardly protruding tabs 44. More specifically, while the second shelf 50 is being transitioned from the upper-forward or second position (see FIG. 6) to the upper-rearward or third position (see FIG. 7), the ramped lower surfaces 72 of the outwardly protruding tabs 60 engage a front end 74 of the inwardly protruding tabs 44 to force the outwardly protruding tabs 60 above the inwardly protruding tabs 44 such that outwardly protruding tabs 60 rest on top of or engage the upper surfaces 64 of inwardly protruding tabs 44 in order to ensure the second shelf 50 is property nested with the first shelf 36 once the second shelf 50 reaches the upper-rearward or third position. The front ends 74 of the inwardly protruding tabs 44 may be rounded to further assist in forcing the outwardly protruding tabs 60 above the inwardly protruding tabs 44 and to prevent jamming between the inwardly protruding tabs 44 and the outwardly protruding tabs 60 during engagement between the inwardly protruding tabs 44 and the outwardly protruding tabs 60.

Figure 11:
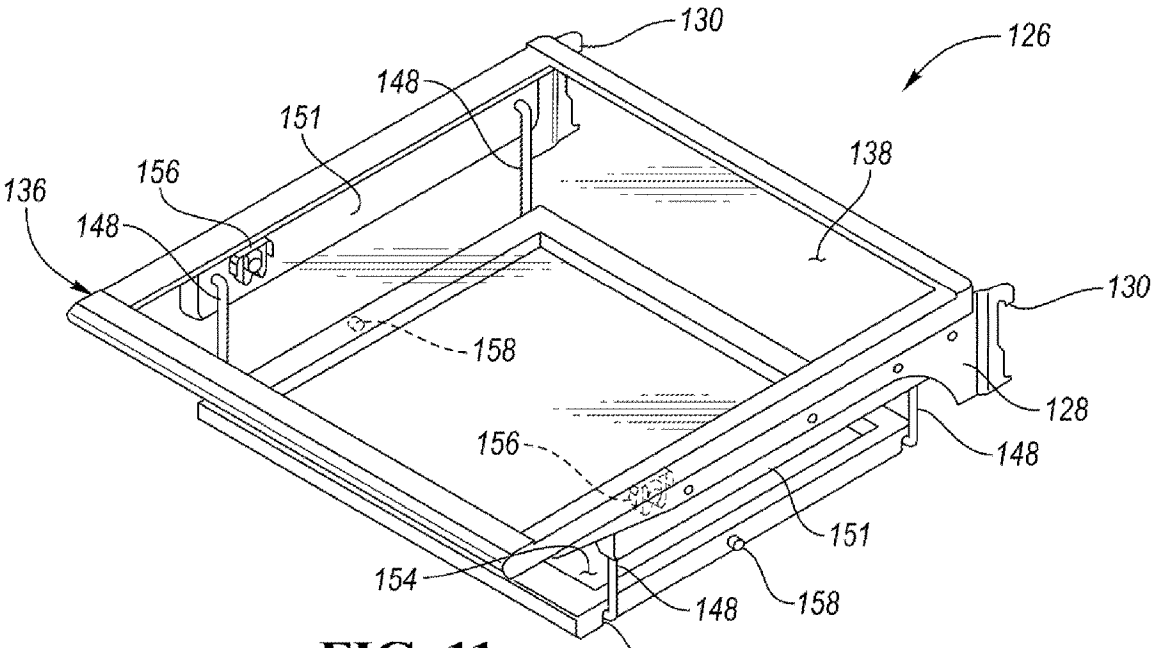
FIG. 11 is an isometric top view of an alternative embodiment of the shelving system.

Referring to FIG. 11, an alternative embodiment of the shelving system 126 is illustrated. The alternative embodiment of the shelving system 126 should be construed to include all of the subcomponents and functionality of shelving system 26 unless otherwise described herein. A single shelving system 126 or multiple shelving systems that are identical to shelving system 126 may be disposed within the internal chamber of the refrigerator. It should be noted that any shelves illustrated in FIG. 2 may be removed or rearranged to create space for one or more of the shelving systems 26 or shelving systems 126. The shelving system 126 may include support arms 128 that engage one of the walls 13 that define the internal chamber 12 in order to secure the position of the shelving system 126 within the internal chamber 12. More specifically, hooks 130 defined along the end of the support arms 128 may extend into notches defined by the wall 13 and may engage upwardly extending protrusions, bumps, walls, etc. within the notches to secure the position of the shelving system 126 within the internal chamber 12, similar to how the hooks 30 secure the shelving system 26 to the wall 13 in FIG. 3. The wall 13 may define a plurality of vertically aligned notches having protrusions disposed therein so that the shelving system 126 can be adjusted upward or downward between notches in order to adjust a height of the shelving system 126 within the internal chamber 12.

The shelving system 126 includes an upper or first shelf 136 that is secured to or is integral to the support arms 128. The first shelf 136 is secured to the wall 13 via the support arms 128. The first shelf 36 has a top or upper surface 138 and a lower or bottom surface that each extend between the support arms 128. Food or other items may be stored on the top surface 138. The top surface 138 may be leveled to in order prevent items that are stored on the top surface 138 from rolling or falling off the top surface 138. It is noted that a panel that defines the upper surface 138 and bottom surface is illustrated as being made from a transparent material, such as glass, in FIG. 11 for illustrative purposes. It should also be noted that although the panel could be made from such a transparent material, this disclosure should not be construed as limited to such a configuration.

The shelving system 126 also includes one or more (or a plurality of) hangers 148. At. Each hanger 148 is rotatably secured to the first shelf 136 at a first end and is rotatably secured to a lower or second shelf 150 at a second end. The second shelf 150 is disposed below the first shelf 36. The first shelf 136, or more specifically adaptors 151 that are secured to a bottom of the first shelf 136, may define orifices and the hangers 148 may have upper horizontal portions that are each disposed within the one of the orifices defined by the adaptors 151 such that the hangers 148 rotate freely relative to the first shelf 136 and the adaptors 151.

The second shelf 150 may define notches 152 and lower horizontal portions of each hanger 148 may be disposed in and may rotate freely within one of the notches 152. The hangers 148 include vertical portions that extend between the upper and lower horizontal portions. The upper horizontal portions and lower horizontal portions of each hanger 148 may be substantially parallel to each other. Substantially parallel may refer to any value that ranges between exactly parallel and 15° from exactly parallel. The vertical portions of each hanger 148 may be substantially perpendicular to the respective upper horizontal portion and lower horizontal portion of each hanger 148. The notches 152 and lower horizontal portions of each hanger 148 may be disposed along edges and at or proximate to each corner of the second shelf 150 to provide balance and stability to the second shelf 150 so that food or other items may be stored on a top surface 154 of the second shelf 150. The vertical portions of each hanger 148 may be sized so that the four corners of the second shelf 150 are approximately located at the same vertical level in order prevent items that are stored on the top surface 154 from rolling or falling off of the top surface 154. Crossbars may extend along a bottom surface of the second shelf 150 and may connect the lower horizontal portions of a pair of hangers 148 to each other in order to provide further stability to the second shelf 150.

The second shelf 150 is configured to rotate upward from a lower position (see FIG. 11) to an upper position where the second shelf 150 is nested with the first shelf 136. Such an example of the positioning of the second shelf 150 relative to the first shelf 136 when the second shelf 150 is nested with the first shelf 136 is demonstrated in FIG. 7 with respect to second shelf 50 and first shelf 36. The difference between shelving system 126 and shelving system 26 is that a locking system is utilized to secure the second shelf 150 to the first shelf 136. The locking system includes one or more locks 156 that are secured to the first shelf 136 (or more specifically to the adapters 151) and one or more protrusions or bosses 158 that extend from the second shelf 150. When the second shelf 150 is in the upper position, the locks 156 are configured to retain the bosses 158, which in turn retains the second shelf 150 in upper positioned where the second shelf 150 is nested with the first shelf 136.

Figure 12:
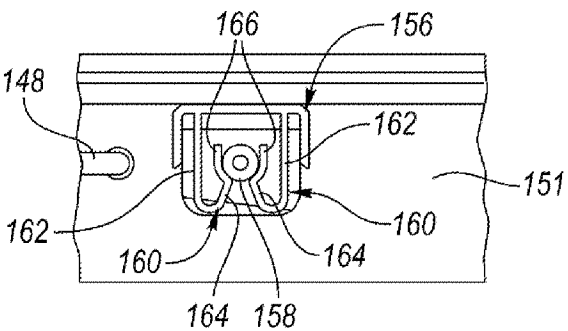
FIG. 12 is a side view of a first embodiment of a locking system that may be utilized to secure a lower shelf to an upper shelf of the alternative embodiment of the shelving system.

Referring to FIG. 12, a first embodiment of one of the locks 156 engaging one of the bosses 158 to secure the second shelf 150 in the upper position is illustrated. The remainder of the second shelf 150 (i.e., the portions of the second shelf 150 other than the boss 158) has been removed in FIG. 12 for illustrative purposes. The first embodiment of the locks 156 includes a pair of opposing J-shaped snaps or clips 160. The clips 160 are configured to flex about biasing arms 162 when the boss 158 is engaging ramped surfaces 164 of each clip 160 during a transition of the lower shelf 150 to the upper position. Once the boss 158 passes beyond and above the ramped surfaces 164, the pair of clips 160 snaps back and the boss 158 is retained in a hand or palm profile 166 that is formed by the pair of opposing clips 160. The ramped surfaces 164 facilitate inserting the boss 158 into and out of a retained position (i.e., where the boss 158 is being retained via the palm profile 166).

Figure 13:
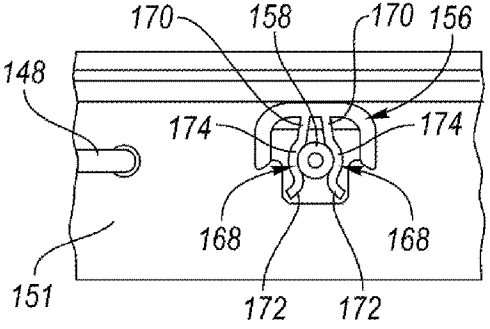
FIG. 13 is a side view of a second embodiment of the locking system that may be utilized to secure the lower shelf to the upper shelf of the alternative embodiment of the shelving system.

Referring to FIG. 13, a second embodiment of one of the locks 156 engaging one of the bosses 158 to secure the second shelf 150 in the upper position is illustrated. The remainder of the second shelf 150 (i.e., the portions of the second shelf 150 other than the boss 158) has been removed in FIG. 13 for illustrative purposes. The second embodiment of the locks 156 includes a pair of opposing inverted flexible clips or snaps 168. The snaps 168 are configured to flex about biasing arms 170 when the boss 158 is engaging ramped surfaces 172 of each snap 168. Once the boss 158 passes beyond and above the ramped surfaces 172, the pair of snaps 168 snap back and the boss 158 is retained within rounded profiles 174 that are formed by the snaps 168. The ramped surfaces 172 facilitate inserting the boss 158 into and out of a retained position (i.e., where the boss 158 is being retained via the rounded profiles 174).

Figure 14:
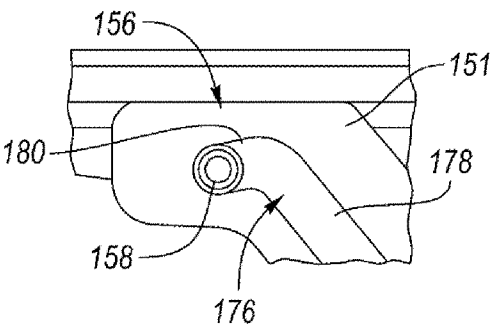
FIG. 14 is a side view of a third embodiment of the locking system that may be utilized to secure the lower shelf to the upper shelf of the alternative embodiment of the shelving system.

Referring to FIG. 14, a third embodiment of one of the locks 156 engaging one of the bosses 158 to secure the second shelf 150 in the upper position is illustrated. The remainder of the second shelf 150 (i.e., the portions of the second shelf 150 other than the boss 158) has been removed in FIG. 14 for illustrative purposes. The third embodiment of one of the locks 156 is comprised of a guideway 176 that is define along an outer surface of the adaptor 151. The guideway 176 includes a first portion 178 that is angled upward and facilitates guiding the boss 158 when the second shelf 150 is being transitioned to the upper position. The guideway 176 also includes a second portion 180 that forms a locking ramp that is angled downward relative to the first portion 178. The downward angle facilities retaining the boss 158 and maintaining the second shelf 150 in the upper position via gravity.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. A refrigerator shelving system comprising:

a first shelf configured to be anchored to an internal surface within an internal chamber of a refrigerator, having an upper surface, having at least one roller guide track below the upper surface, and having at least one inwardly protruding tab disposed below the upper surface, wherein the at least one inwardly protruding tab protrudes inward from the at least one roller guide track;

at least one roller disposed within the at least one roller guide track;

at least one stop disposed within the at least one roller guide track, wherein the at least one stop is configured to limit linear movement of the at least one roller within the at least one roller guide track;

at least one hanger rotatably secured the at least one roller; and a second shelf rotatably secured to the at least one hanger and having at least one outwardly protruding tab, wherein (i) the second shelf is configured to rotate upward and forward about the rollers upon engagement between the at least one roller and the at least one stop to transition from a first position to a second position, and (ii) the second shelf is configured to slide rearward from the second position to a third position such that the at least one outwardly protruding tab engages the at least one inwardly protruding tab to nest the second shelf to the first shelf.

2. The refrigerator shelving system of claim 1, wherein the second shelf is suspended below the first shelf via the at least one hanger in the first position.

3. The refrigerator shelving system of claim 1, wherein the second shelf is disposed at least partially forward of the first shelf in the second position.

4. The refrigerator shelving system of claim 1, wherein (i) at least one rail is disposed within the at least one roller guide track, (ii) the at least one roller defines at least one groove, and (iii) the at least one rail is disposed within the at least one groove to guide the at least one roller within the at least roller guide one track.

5. The refrigerator shelving system of claim 4, wherein the at least one stop comprises at least one protrusion extending from the at least one rail.

6. The refrigerator shelving system of claim 1, wherein a lower surface of the at least one outwardly protruding tab is ramped to facilitate engagement between the at least one outwardly protruding tab and the at least one inwardly protruding tab.

7. The refrigerator shelving system of claim 1, wherein the first shelf includes at least one second stop configured to limit rearward movement of the at least one hanger when the second shelf is in the first position.

8. A shelving system comprising:

a first shelf configured to be anchored to an internal surface within an internal chamber of a refrigerator, having an upper surface, and having roller guide tracks below the upper surface;

rollers disposed within the roller guide tracks;

rails disposed within the roller guide tracks, wherein (i) the rollers define grooves and (ii) the rails are disposed within the grooves to guide the rollers within the roller guide tracks;

stops disposed within the roller guide tracks, wherein the stops are configured to limit linear movement of the rollers within the roller guide tracks;

hangers rotatably secured to the rollers; and a second shelf rotatably secured to the hangers, wherein (i) the second shelf is configured to rotate about the rollers via the hangers upon engagement between the rollers and the stops to transition from a lower position to an upper-forward position, (ii) the second shelf is configured to slide rearward from the upper-forward position to an upper-rearward position, and (iii) the second shelf is configured to nest with the first shelf in the upper-rearward position.

9. The shelving system of claim 8, wherein the second shelf is suspended below the first shelf via the hangers in the lower position.

10. The shelving system of claim 8, wherein the second shelf is disposed at least partially forward of the first shelf in the upper-forward position.

11. The shelving system of claim 8, wherein the stops comprise protrusions extending from the rails.

12. The shelving system of claim 8, wherein (i) the first shelf includes inwardly protruding tabs that are disposed below the upper surface, wherein the inwardly protruding tabs protrude inward from the roller guide tracks, (ii) the second shelf includes outwardly protruding tabs, and (iii) the outwardly protruding tabs are configured to engage the inwardly protruding tabs to nest the second shelf to the first shelf in the upper-rearward position.

13. The shelving system of claim 12, wherein lower surfaces of the outwardly protruding tabs are ramped to facilitate engagement between the outwardly protruding tabs and the inwardly protruding tabs.

14. The shelving system of claim 12, wherein lower surfaces of the outwardly protruding tabs are configured to rest on top of upper surfaces of the inwardly protruding tabs to nest the second shelf to the first shelf in the upper-rearward position.

15. The shelving system of claim 8, wherein the first shelf includes a lock and the second shelf includes a boss configured to engage the lock to secure the second shelf to the first shelf.

16. A refrigerator appliance comprising:

a housing defming an internal chamber; and a shelving system disposed within the internal chamber, the shelving system comprising, an upper shelf anchored to an internal surface that partially defines the internal chamber, first and second opposing roller guide tracks disposed along a bottom surface of the upper shelf, internal tabs protruding inward from the first and second roller guide tracks, a plurality of rollers, wherein a first portion of the plurality of rollers is disposed within the first roller guide track and a second portion of the plurality of rollers is disposed within the second roller guide track, stops disposed within the first and second roller guide tracks, wherein the stops are configured to limit linear movement of the plurality of rollers within the first and second roller guide tracks, a plurality of hangers, each rotatably secured to one of the plurality of rollers, a lower shelf disposed below the upper shelf and rotatably secured to each of the plurality of hangers, and external tabs protruding outward from the lower shelf, wherein (i) the lower shelf is configured to pivot upward and forward about the plurality of rollers and via the hangers from a lower level to an upper level upon engagement between the plurality of rollers and the stops, and (ii) the lower shelf is configured to slide rearward at the upper level from an advanced position to a retracted position that is below the upper shelf such that the external tabs engage upper surfaces of the internal tabs to retain the lower shelf in the retracted position at the upper level.

17. The refrigerator shelving system of claim 16, wherein (i) rails are disposed within the first and second opposing roller guide tracks, (ii) the plurality of rollers define grooves, and (iii) the rails are disposed within the grooves to guide the rollers within the first and second opposing roller guide tracks.

18. The refrigerator shelving system of claim 17, wherein the stops comprise protrusions extending from the rails.

19. The refrigerator shelving system of claim 16, wherein lower surfaces of the external tabs are ramped to facilitate engagement between the external tabs and the internal tabs.

* * * * *